US006116664A

United States Patent [19]

Wegner

[11] Patent Number: 6,116,664

[45] Date of Patent: Sep. 12, 2000

[54] LOCK, IN PARTICULAR FOR CAR DOORS OR THE LIKE

[75] Inventor: Torsten Wegner, Wiesbaden, Germany

[73] Assignee: Mannesmann VDO AG, Frankfurt, Germany

[21] Appl. No.: 08/924,494

[22] Filed: Aug. 27, 1997

[30] Foreign Application Priority Data

Aug. 31, 1996 [DE] Germany ..... 196 35 414

[51] Int. Cl.[7] ..... E05C 3/06; E05C 3/16

[52] U.S. Cl. ..... 292/216; 292/201; 292/DIG. 23

[58] Field of Search ..... 292/201, 216, 292/DIG. 23

[56] References Cited

U.S. PATENT DOCUMENTS

| | | | |
|---|---|---|---|
| 1,899,997 | 3/1933 | Sullivan . | |
| 4,588,217 | 5/1986 | Escaravage | 292/201 |
| 4,998,758 | 3/1991 | Kowalczyk et al. | 292/201 |
| 5,100,185 | 3/1992 | Menke et al. | 292/216 |
| 5,309,745 | 5/1994 | Ursel et al. | 292/201 |
| 5,676,003 | 10/1997 | Ursel et al. | 70/472 |
| 5,697,236 | 12/1997 | Kleefeldt et al. | 292/201 |
| 5,702,136 | 12/1997 | Funk et al. | 292/216 |

FOREIGN PATENT DOCUMENTS

| | | |
|---|---|---|
| 19547729 | of 0000 | Germany . |
| 2631001 | 6/1977 | Germany . |
| 2717696 | 11/1978 | Germany . |
| 33 19 354 | 12/1983 | Germany . |
| 44 33 994 | 3/1994 | Germany . |
| 19619849 | 7/1997 | Germany . |
| 2073299 | 10/1981 | United Kingdom . |
| 2108191 | 5/1983 | United Kingdom . |

*Primary Examiner*—B. Dayoan
*Assistant Examiner*—John B. Walsh
*Attorney, Agent, or Firm*—Martin A. Faber

[57] ABSTRACT

A lock, in particular for motor vehicle doors or the like, having a rotary latch which can be locked via a pawl and can be released by the pawl. For this purpose, a release force acts or does not act on the pawl via a coupling member movable by an actuator as a function of commands by an operator. The coupling member can be moved by the actuator into at least three positions.

6 Claims, 3 Drawing Sheets

LOCK, IN PARTICULAR FOR CAR DOORS OR THE LIKE

FIELD AND BACKGROUND OF THE INVENTION

The present invention relates to a lock, particularly a lock (1) for motor vehicle doors, or the like, having a rotary latch (1.1) which can be locked in position and released by a pawl (1.9), wherein a release force acts or does not act on the pawl (1.9) via a coupling member (2.6), the coupling member being movable by an actuator (2), in accordance with commands of an operator.

From German patent document DE 195 47 729.4, a lock having a coupling device is known which has a rotary latch which can be locked in position and released by a pawl. A release force acts or does not act on the pawl in accordance with commands of an operator, the release force being transmitted via a coupling member of the coupling device, which member is movable by an actuator. In this connection, the coupling member is arranged between a coupling element and the pawl, the coupling element being movable between two positions by the actuator. If the coupling member lies within the region of stop surfaces, then a release force acting on the coupling element can be transmitted via the coupling member to the pawl so that the rotary latch is released from its locked position and the door can be opened. If the coupling member does not lie within the region of the stop surfaces, an idle stroke is carried out and the pawl is not actuated, so that the door remains closed. The manner of operation of the coupling device actuated by the actuator is described in German patent document DE 195 47 729.4 and in itself operates satisfactorily.

It has now been found that the carrying out of several lock functions (anti-theft position, central lock, unlocked position, and possibly child-proof door catch, said functions being known per se) is possible with the known lock but extensive control work is necessary leads to delays, particularly in critical situations (for instance, accidents), in movements in the coupling member. If, for instance, the coupling member is in the anti-theft position, movement of the coupling member into another position is always necessary in order to open the door by means of a manipulator. This is disadvantageous, and in particular dangerous, if no current is available any longer for the actuator, as the result, for instance, of an accident.

In order to take care of this case, German patent document DE 195 47 729.4 proposes as alternative that the coupling member be in the coupled position. If an anti-theft position is desired by the operator, then the lock operates in the manner that the coupling member remains in the coupled position and the actuation of a manipulator is detected, which then effects an uncoupling of the coupling member. In this case, it may happen that, in the event of sufficiently rapid actuation of the manipulator, this uncoupling is not effected sufficiently fast so that the door can be opened without authorization.

SUMMARY OF THE INVENTION

It is an object of the invention so to improve such a lock with a coupling device which, while retaining its functions, avoids the foregoing disadvantages, and the lock is actuated sufficiently rapidly, particularly in the case of dangerous situations.

According to the invention, a coupling member (2, 6) can be moved into at least three positions by an actuator (2).

The movement of the coupling member into at least three positions effected by the actuator has the advantage that the coupling member is originally in a first position (central locking position) in which the door can be opened by the door inside handle but not by the door outside handle. If the driver, for instance, turns the engine off and desires an anti-theft position in which the door cannot be opened either by the door outside handle nor by the door inside handle, there is sufficient time to move the coupling member into a second position (anti-theft position). If the driver returns to his car and desires to open the door by means of the door outside handle, there is again also sufficient time to move the coupling member by the actuator into a third position (unlocked position) in which it is possible to open the door both by means of the door outside handle and by means of the door inside handle. In addition, it is also possible to move the coupling member into a fourth position (child-proof door-catch position) in which it is possible to open the door by means of the door outside handle but not to open it by the door inside handle.

As a further development of the invention, position-detecting means are associated with the actuator or the coupling member, the actuator being controlled as a function of the position detected. If the coupling member is, for instance, in the central locking position and if an anti-theft position is desired, then the actuator is operated (connected) as a function of the corresponding command by the operator, so that the coupling member is moved into the anti-theft position. When this position has been reached, it is detected by the position-detection means and the actuator is disconnected.

As an alternative embodiment of the invention, the actuator is a stepping motor. By suitable control of the stepping motor, and in particular by the stipulating of a given number of steps of the stepping motor, at least the foregoing three positions can be brought about. An electric motor (for instance, a dc motor) wherein the revolutions of the output shaft are counted by a detection means (for instance, a microswitch) can also be used.

According to the invention, each handle (door inside handle 3, door outside handle 4) is connected by connecting members to a coupling element (1.11) which, depending on the position of the coupling member (2.6), acts or does not act directly or indirectly on the pawl (1.9).

Still according to an embodiment of the invention, the coupling elements (1.11) do not have overlapping resting surfaces (stops 1.26A and 1.26B) in their direction of movement, and the pawl (1.9) has a resting surface (stop 1.27) which does not overlap the resting surfaces.

Further, the invention provides that the coupling elements (1.11) and/or the pawl (1.9) have at least one recess (8, 9, 11) into which the coupling member (2.6), and particularly a pin (14) of the coupling member (2.6), can engage without actuation of the pawl (1.9).

According to still another feature, means for detecting the position are associated with the actuator (2) or the coupling member (2.6), the actuator being controlled as a function of the position detected.

Also, the actuator (2) can be a stepping motor.

BRIEF DESCRIPTION OF THE DRAWINGS

With the above and other objects and advantages in view, the present invention will become more clearly understood in connection with the detailed description of preferred embodiments, when considered with the accompanying drawings, of which.

DETAILED DESCRIPTION OF THE PREFERRED EMBODIMENTS

Figure 1:
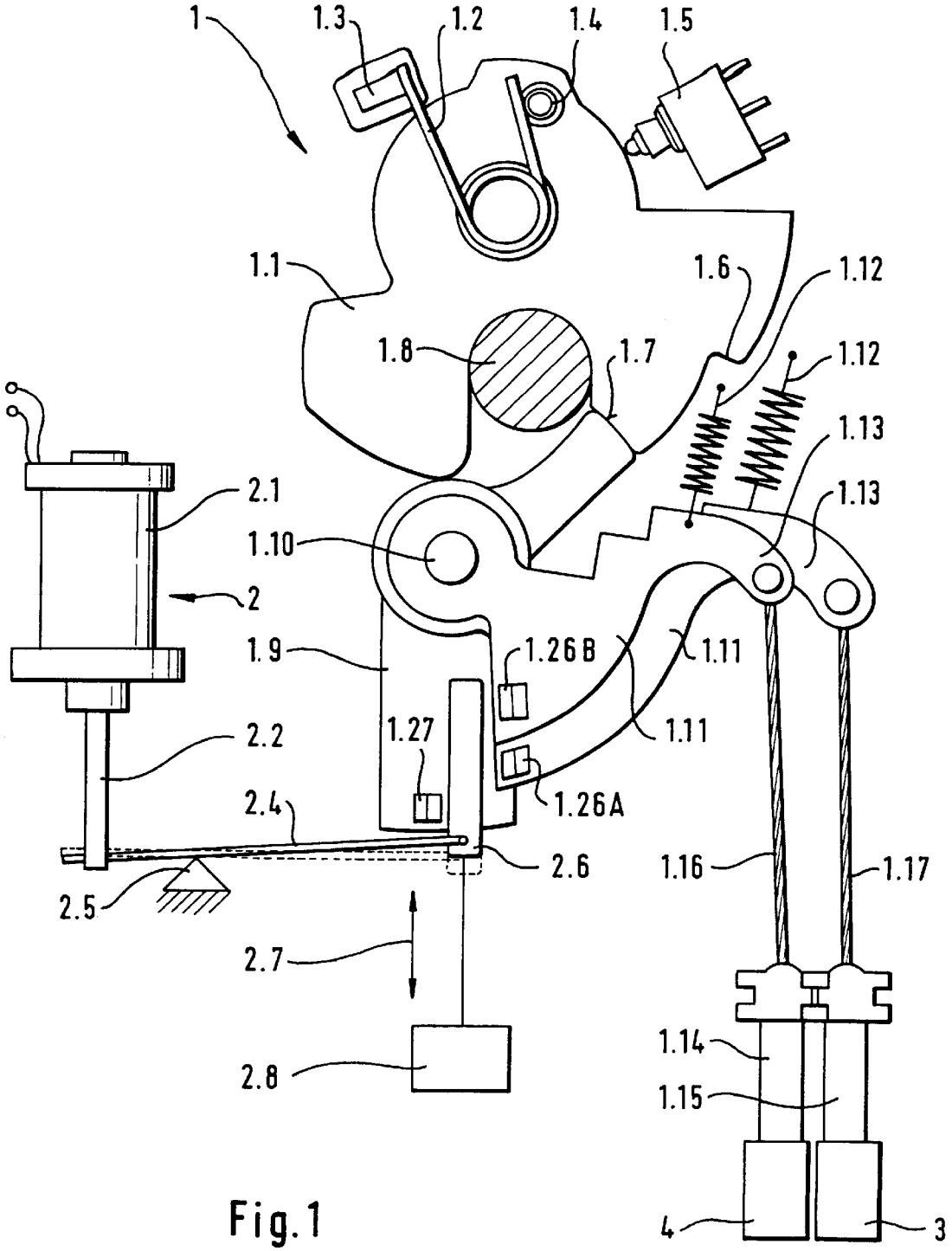
FIG. 1 shows a first embodiment of a lock of a coupling device.

A lock 1, shown in FIG. 1, has a rotary latch 1.1 which acts against a rotary-latch spring 1.2 which is connected between a stationary stop 1.3 and a stop 1.4 arranged on the rotary latch 1.1. The position of the rotary latch 1.1 can be detected by means of a rotary-latch switch 1.5. Furthermore, the rotary latch 1.1 has a shoulder 1.6 by which an intermediate detent position (pre-detent) is provided. Furthermore, a stop surface 1.7 is present via which the rotary latch 1.1 is held in its locked position. The two arms of the U-shaped rotary latch 1.1 surround a closure wedge 1.8 and thus, for instance, hold a car door in known manner in its closed position. A pawl 1.9, which is swingable around a pivot point 1.10, rests via a projection (not shown in detail) in FIG. 1 against the resting surface 1.7 of the rotary latch 1.1. There are also mounted around the pivot point 1.10 or another pivot point, two coupling elements 1.11 which are held by springs 1.12 in the position shown in FIG. 1 (possibly resting against a stop, not shown).

Projections, 1.13 on the corresponding coupling elements 1.11 serve as means which engage to turn the coupling element 1.11 out of the position shown around the pivot point 1.10. These means are, for instance, connected to a door inside handle 3 or a door outside handle 4 or other manipulators by which the two coupling elements 1.11 can be actuated mechanically independently of each other. In FIG. 1 it is shown that these means may be Bowden cables 1.14 and 1.15, each having a pawl 1.16 and 1.17 which pawls in their turn are acted on by springs 1.12. Upon actuation of the door inside handle 3 or the door outside handle 4, the corresponding coupling element 1.11 is turned and, under certain circumstances which will be explained further below, moves the pawl 1.9 out of its locked position shown into an opening position so that the rotary latch 1.1 releases the closure wedge 1.8. The actuating of the door inside handle 3 or the door outside handle 4 is detected in each case by means of a switch (as will be described in FIG. 2).

There is furthermore provided an actuator/actuator means 2 which is, for instance, an electromagnet 2.1 having a linearly displaceable actuating member 2.2 which can act against a spring. As actuator, there can also be used one which produces a movement of rotation which is converted into a linear movement. A locking in position of the actuator then takes place by the holding moment thereof. The displacement of the actuator member 2.2 acts on a lever 2.4 which is swingable around a pivot point 2.5. Instead of the linear movement, there can also be provided an actuator having a rotary movement or a combination of the two. The swinging of the lever 2.4 around the pivot point 2.5 results in a substantially linear displacement of a coupling member 2.6 in a direction of movement 2.7. It is also possible for the actuator 2 to act directly, or stepped down or up, on the coupling member 2.6, in which connection linear or rotary movements are again also possible. In FIG. 1 it is shown that the coupling member 2.6 has essentially an elongated rectangular shape, other embodiments adapted to the construction (such as, for instance, a wedge-shaped embodiment) being also possible. It is furthermore possible for the coupling member 2.6 and/or the components (for instance actuator 2, lever 2.4) actuating the coupling member 2.6 to be arranged on the pawl 1.9 or the coupling element 1.11. Means 2.8, for instance a lock-cylinder, are connected to the coupling member 2.6, to locate this member 2.6 between these stops by using a key.

The corresponding coupling elements 1.11 have stops 1.26A and 1.26B, and the pawl 1.9 has a stop 1.27 which stops are staggered with respect to each other. The coupling member 2.6 can be located between the two stops 1.26A and 1.27 or between the stops 1.26A, 1.26B and 1.27 or be displaceable out of this region of the stops upon actuation of the actuator 2, or vice versa.

Figure 2:
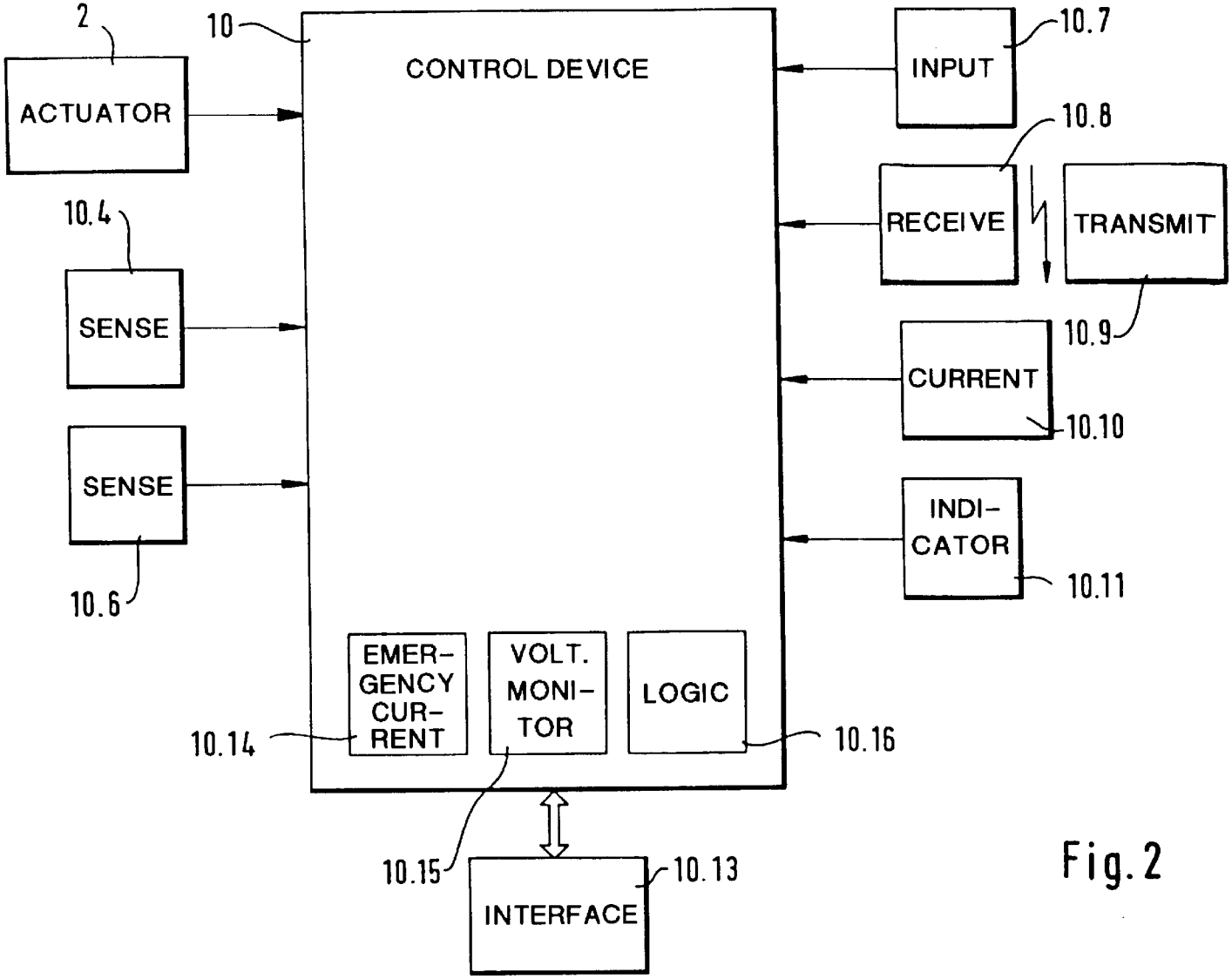
FIG. 2 shows an actuator.

FIG. 2 shows a control device 10 by which the control of the actuator is effected as a function of opening or closing commands. For this purpose, the control device 10 is connected with the actuator 2 (in particular, the electromagnet 2.1), the control device 10 receiving information as to the actuating of the manipulators 3,4 (door handle, push button or the like) via sensors (switches or the like) 10.4 and/or information as to the position of the rotary latch 1.1 via a sensor 10.6 (rotary-latch switch 1.5). Furthermore, the control device 10 has associated with it an input device 10.7 (for instance a switch for the activating or deactivating of a child-proof door catch) and a receiving device 10.8, opening or closing commands being transmitted via a transmitter 10.9 to the receiving device 10.8. Furthermore, a current supply 10.10 and an indicating device 10.11 (for indication of the status) are associated with the control device 10. In addition, the control device 10 can be provided with an interface 10.13 via which given functions can be ordered by means of which further information as to the status of the motor vehicle can be transmitted to the control device 10. There are preferably integrated in the control device 10 an emergency current supply 10.14 and a voltage monitoring 10.15 which, for instance, activates the emergency current supply 10.14 if a predetermined voltage threshold is dropped below. The two components 10.14 and 10.15 may be present, but need not be. By the reference numeral 10.16 there is indicated a combined input and output control and a control logic and memory logic with which, for instance, the functions of the control device 10, contained in a program, can be carried out.

The control device 10 operates as follows:

The coupling member 2.6 is connected in a basic position, so that it is within the region of the stops 1.26A and 1.27. This applies to the "central-lock" position, so that upon actuation of the door inside handle 3 the stop 1.26A comes to rest via the coupling member 2.6 against the stop 1.27 and upon a further swinging around the axis of rotation 1.10, turns the pawl 1.9 and thus releases the rotary latch 1.1. In a second "unlocked" position, the coupling member 2.6 is moved into the region between the stop 1.27 and the two stops 1.26A and 1.26B so that, upon an actuation independent of each other of the door inside handle 3 or the door outside handle 4, the course of movement already described is carried out, so that the door of the vehicle can be opened both from the outside and from the inside. By the actuator 2, the coupling member 2.6 can be moved still into a third position in which the stops 1.26A and 1.26B cannot be brought against the coupling member 2.6 so that actuation of both the door inside handle 3 and the door outside handle 4 is without effect, an anti-theft position being thus reached. This means that the coupling member 2.6, starting from a first position (central-lock), can be brought by the actuator 2 into at least two other positions (unlocked position, anti-theft position). As an alternative to this, it is also possible for the coupling member 2.6 to be fundamentally in the anti-theft position and therefore not in the region of the stops 1.26A and 1.26B, and for the actuator 2 to move the coupling member 2.6 into the region of the stop 1.26A in order to establish the central-lock position and further into the region of the stop 1.26B in order to establish of the unlock position.

Figure 3:
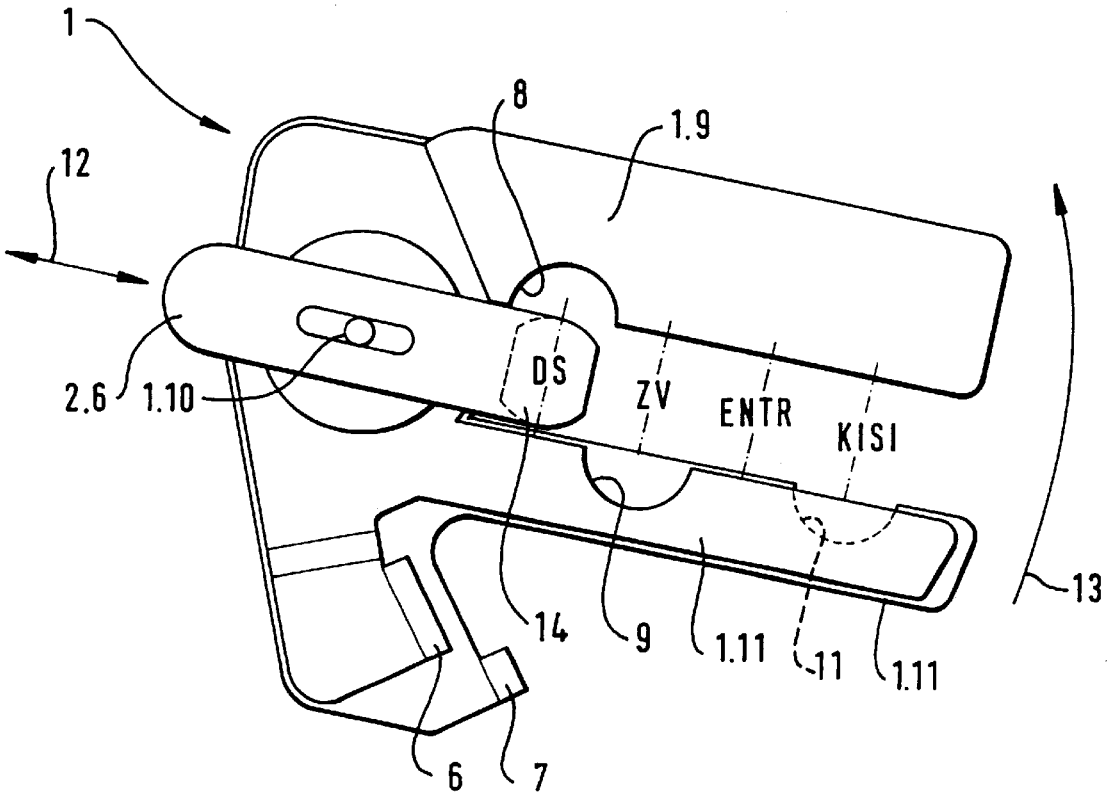
FIG. 3 shows another embodiment of a lock of a coupling device.

FIG. 3 shows another embodiment of the lock 1, in which components identical to those of FIG. 1 are provided with the same reference numerals. As a modification of the embodiment shown in FIG. 1, the two coupling elements 1.11 are developed as approximately T-shaped levers, this being a preferred but not a limitative embodiment. The two coupling elements 1.11 are again preferably mounted around a common axis of rotation 1.10, in which connection, on an end region of the coupling elements 1.11, in particular at the end regions designated by the reference numerals 6 and 7, the connecting elements such as Bowden cables, rods, or the like which lead to the door inside handle 3 and the door outside handle 4 (not shown in FIG. 3) are attached.

In the embodiment of the invention shown in FIG. 3, it is now provided that the pawl 1.9 has a recess 8 and each of the two coupling elements 1.11 has a recess 9 and 11 respectively, the recesses 8, 9 and 11 being staggered with respect to each other and not arranged congruently in the pawl 1.9 or the coupling elements 1.11. For the establishing of the desired positions there is again present a coupling member provided with the reference numeral 2.6 which, on the one hand, can carry out a linear movement 12 which is effected by the actuator 2 and, in addition to this, is so mounted that it can carry out a rotary movement 13 around the axis of rotation 1.10, brought about by an actuation of the manipulator.

The specific establishing of the desired positions is achieved by a pin 14, arranged on the coupling member 2.6, in combination with recesses 8, 9 and 11 and the linear movement 12 as well as well as the rotary movement 13. This functions as follows:

In the position of the pin 14 shown in FIG. 3, the lock 1 is in its anti-theft position (DS), so that although the pin 14 is swung around the axis of rotation 1.10 upon actuation of the door inside handle 3 and of the door outside handle 4, the pawl 1.9 is, however, brought into the recess 8, so that an empty stroke of both manipulators is present and the pawl 1.9 is not actuated. The door remains closed. If an operator wants the door to be opened, the pin 14 is brought from the anti-theft position into an unlock position ENTR, in which, upon actuation of one of the two coupling elements 1.11 by a manipulator, the pin 14 is pressed around the axis of rotation 1.10 against the pawl 1.9 and carries the latter along with it, and the rotary latch 1.1 is released.

Thus, the opening of the door is possible both from the inside and from the outside. Upon start of travel, the pin 14 either remains in this unlocked position so that it is possible at any time to open the door from the outside or inside, or it is moved into a central-lock position (ZV) as a function of a parameter (for instance "ignition on", "detection that the door has been closed", presence of a given minimum speed). Thereby, while it is possible to open the door from the inside since the coupling element 1.11 which is connected to the door inside handle 3 can press the pin 14 against the pawl 1.9, it is not possible to open the door from the outside since the pin 14 is in the region of the recess 9 of the coupling element 1.11, so that an empty stroke is carried out upon actuation of the door outside handle 4. It is furthermore shown in FIG. 3 that the coupling member 2.6, and thus the pin 14, can be moved into a fourth position (child-proof door-catch KlSl) in which the opening of the door (in particular the rear door) from the inside is then no longer possible. The coupling element 1.11 which is connected with the door outside handle 4 is then so developed that access to this door from the outside is possible.

In connection with the manner of operation of the coupling device shown in FIG. 3 which has been described, it is furthermore also possible that the pin 14 be moved from the unlocked position into the further positions. This has the advantage that, in the normal case, the immediate opening of the door is possible, and therefore without prior movement of the pin 14. This is advantageous, particularly in the case of emergencies. In the event that the pin 14 is moved from its unlocked position (or central-lock position or child-proof door-catch position) into the anti-theft position, sufficient time is available. As an alternative to this, the pin 14 is in the central locked position and is moved into the further positions as a function of the commands of an operator.

In FIG. 1 it is shown that the actuator 2 is developed as an electromagnet. As an alternative to this, the actuator is an electric motor with stepped-down gearing behind it or is a stepping motor so that the actuator can move the coupling member 2.6 directly into at least three and preferably four positions. This can take place, for instance, in the case of a stepping motor by a suitable control in which electromagnets or sensors corresponding to the electric motor for the end positions and the intermediate positions are necessary. It is also possible to provide stops in the end regions for the coupling member 2.6.

Up to now, it has been described that the actuator 2 is activated at least as a result of the operating of a manipulator (door inside handle 3, door outside handle 4), in which connection the actuation can be detected by means of a switch. As an alternative to this, it is now also possible, to omit a detection device (switch) for the actuation of the manipulators handles to adjust the actuator 2 as a function of other parameters. Referring to FIG. 3, one starts for instance with the pin 14 in the anti-theft (DS) position which the pin 14 has assumed when the engine has been turned off by an operator (for instance the driver) and locked by a remote control. Opening of the door is not possible in this position. If the operator now wishes to open the vehicle, the actuator 2 is imparted a control signal via the control device 10 from the transmitter 10.9 and moves the pin 14 into the unlocked position (ENTR). In this way, opening of the door is possible both from the inside and from the outside without switches on the manipulator being necessary for this.

As a function of other parameters, such as, for instance, the turning-on of the ignition or the exceeding of a predetermined minimum speed, the actuator 2 again receives a control signal from the control device 10 and moves the pin 14 from the unlocked position (ENTR) into the central-lock position (ZV) in which the door can be opened by the door inside handle 3 but not by the door outside handle 4. The control device 14 is advantageously so developed that, in the case of the front doors, the pin 14 is not moved into the central-lock position (ZV), but into the child-proof door-catch position (KlSl) in which the front door can be opened only by means of the door outside handle 4 but not by means of the door inside handle 3. This provides the advantage that the actuator 2 is then activated if sufficient time is available for the movement of the pin 14 between the possible positions. In the event that sufficient time for the displacement is not available (for instance upon a crash), the pin 14 is already in a position (in particular the central-lock position (ZV) or, as an alternative to this, the pin 14 is in the unlocked position (ENTR)) in which the door can be opened via at least one handle (door inside handle 3 and/or door outside handle 4). The same is true also for the construction shown in FIG. 1 and also for similar constructions or constructions of similar action. Thus, as an alternative to the manner of operation described in connection with FIG. 2, control of the actuator 2 as a function of the actuating of a manipulator is no longer necessary.

I claim:

1. A lock, suitable for a motor vehicle having a plurality of handles and a door, comprising:

a pawl, and a rotary latch which is lockable in position and released by the pawl;

a coupling member and an actuator means, wherein a release force acts or does not act on the pawl via the coupling member, the coupling member being movable by the actuator in accordance with commands of an operator; and wherein the coupling member is movable into at least three different positions by the actuator means;

wherein, upon insertion of said lock into the vehicle and wherein the lock is adapted to be connected to said plurality of handles, the actuator means is operative to provide that, in a first of said positions the coupling member is non-responsive to any of said handles, in a second of said positions the coupling member is responsive to one of said handles but not all of said handles, and in a third of said positions the coupling member is responsive to two of said handles.

2. A lock according to claim 1, wherein one of said plurality of handles is an inside handle located on the door and a second of said plurality of handles is an outside handle located on the door, the lock further comprising a plurality of coupling elements, and a plurality of connecting members; and wherein respective ones of the handles are connected by respective ones of the connecting members to respective ones of the coupling elements which, depending on a position of the coupling member, act or do not act directly or indirectly on said pawl.

3. A lock according to claim 2, wherein said coupling member is located alongside said pawl, and each of said coupling elements has a resting surface for contacting said coupling member;

the resting surfaces of the respective coupling elements act independently in their respective directions of movement for contacting said coupling member; and the lock further comprises a stop disposed on said pawl for contacting said coupling member, all of said resting surfaces and said stop being spaced apart from each other along a direction normal to a direction of movement of any one of said coupling elements.

4. A lock according to claim 2, further comprising at least one recess disposed in one of said coupling elements and said pawl; and wherein said coupling member includes a pin; and said recess is engageable by said pin with said coupling member without actuation of said pawl.

5. A lock according to claim 1, further comprising means for detecting a position of said actuator means or said coupling member, the actuator means being controllable as a function of a position detected.

6. A lock according to claim 1, wherein the actuator means comprises a stepping motor.

* * * * *